United States Patent [19]

Dimeff et al.

[11] 3,978,364

[45] Aug. 31, 1976

[54] INTEGRATED STRUCTURE VACUUM TUBE

[75] Inventors: John Dimeff, San Jose, Calif.; William J. Kerwin, Tucson, Ariz.

[73] Assignee: The United States of America as represented by the Administrator of the National Aeronautics and Space Administration, Washington, D.C.

[22] Filed: July 24, 1974

[21] Appl. No.: 491,418

[52] U.S. Cl. ..... 313/306; 313/250; 313/309; 313/338

[51] Int. Cl.[2] ..... H01J 1/46; H01J 21/10

[58] Field of Search ..... 313/250, 306, 337, 338, 313/309

[56] References Cited

UNITED STATES PATENTS

| | | | |
|---|---|---|---|
| 3,066,236 | 11/1962 | Sandbank | 313/250 |
| 3,320,464 | 5/1967 | Dill | 313/250 X |
| 3,463,978 | 8/1969 | Varadi | 313/250 |
| 3,701,919 | 10/1972 | Geppert | 313/250 |
| 3,748,522 | 7/1973 | Geppert | 313/337 |
| 3,824,478 | 7/1974 | Mueller | 313/338 |

*Primary Examiner*—Saxfield Chatmon, Jr.
*Attorney, Agent, or Firm*—Darrell G. Brekke; Armand G. Morin, Sr.; John R. Manning

[57] ABSTRACT

High efficiency, multi-dimensional thin film vacuum tubes suitable for use in high temperature, high radiation environments are described. The tubes are fabricated by placing, as by photolithographic techniques, such as are used in solid state integrated circuits, thin film electrode members in selected arrays on facing interior wall surfaces of an alumina substrate envelope. Cathode members are formed using thin films of triple carbonate. The photoresist used in photolithography aids in activation of the cathodes by carbonizing and reacting with the reduced carbonates when heated in vacuum during forming. The finely powdered triple carbonate is mixed with the photoresist used to delineate the cathode locations in the conventional solid state photolithographic manner. Upon high temperature forming (1000° C) the barium, etc. is formed at the surface. Anode and grid members are formed using thin films of refractory metal. Electron flow in the tubes is between grid elements from cathode to anode as in a conventional three-dimensional tube. Both circular geometry for average requirements as well as a repeated linear structure for increased current and power handling capability are employed.

12 Claims, 25 Drawing Figures

FIG.2E
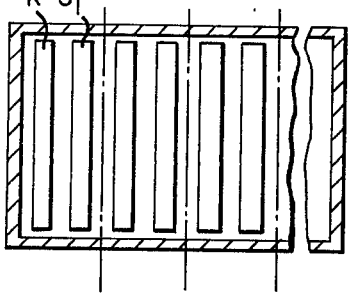
FIG.2F
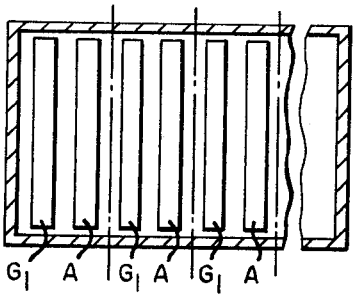
FIG.3A
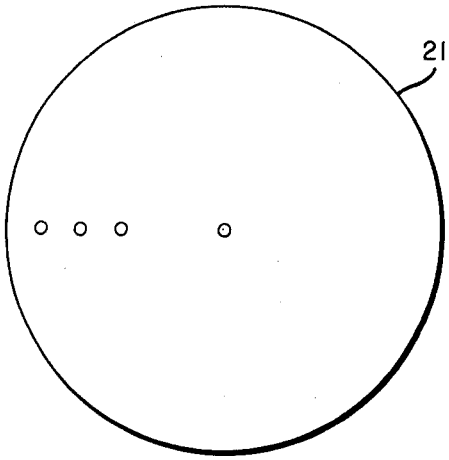
FIG.3B
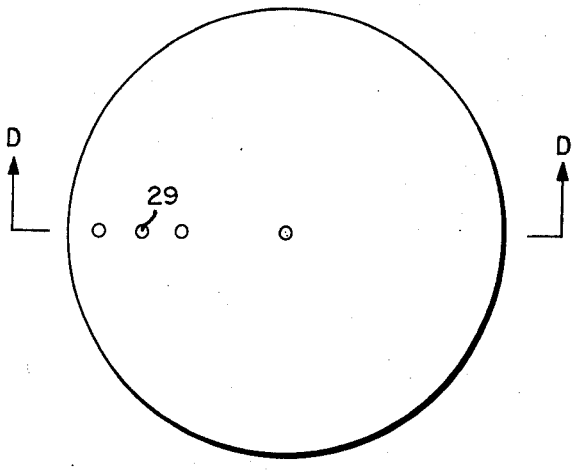
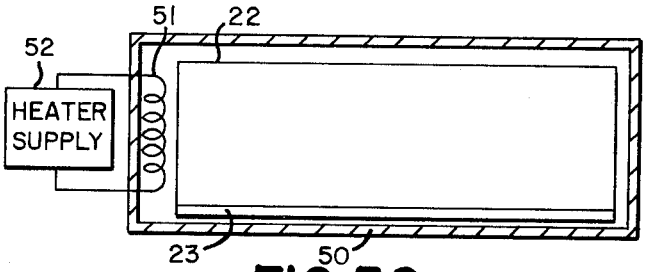
FIG.3C
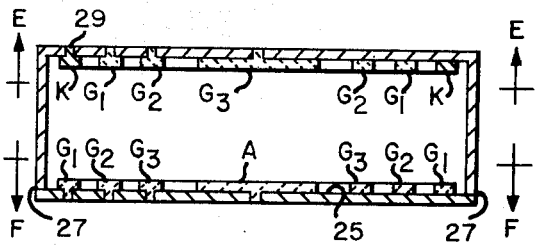
FIG.3D
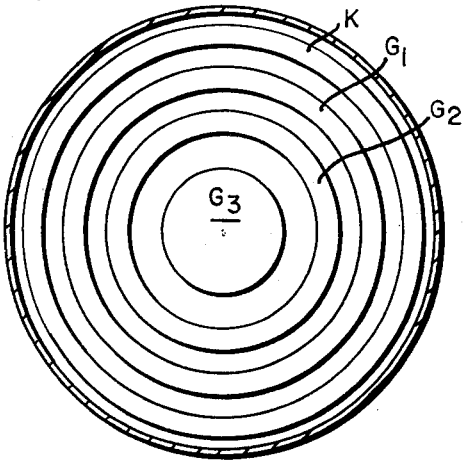
FIG.3E
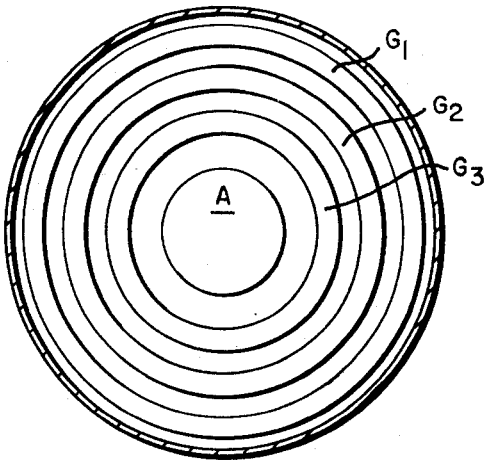
FIG.3F FIG. 4A
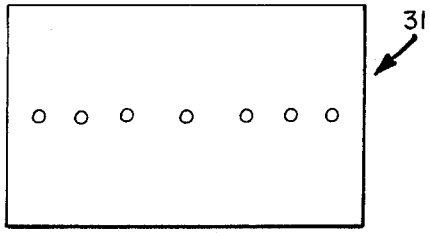
FIG. 4B
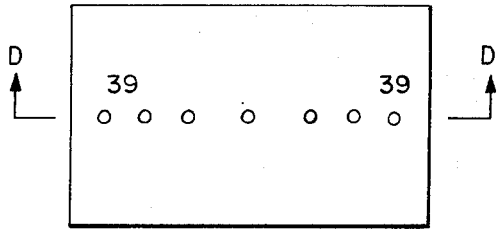
FIG. 4C
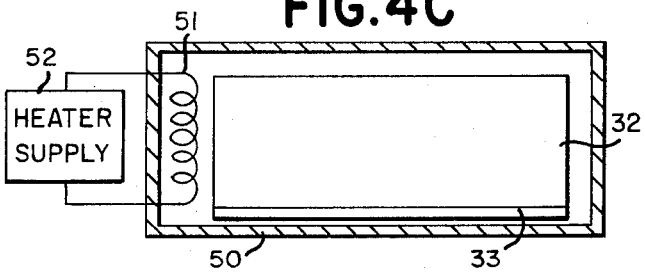
FIG. 4D
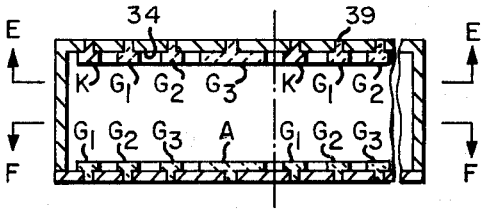
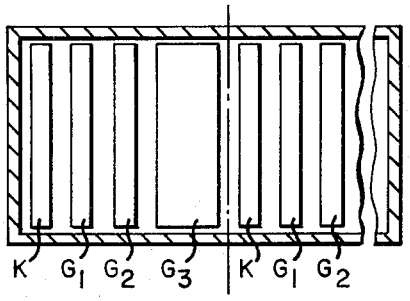
FIG. 4E
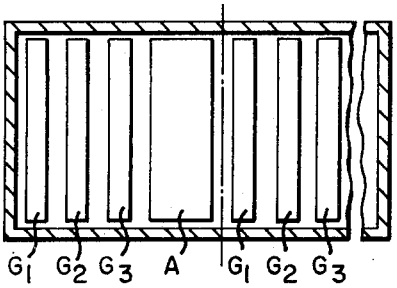
FIG. 4F
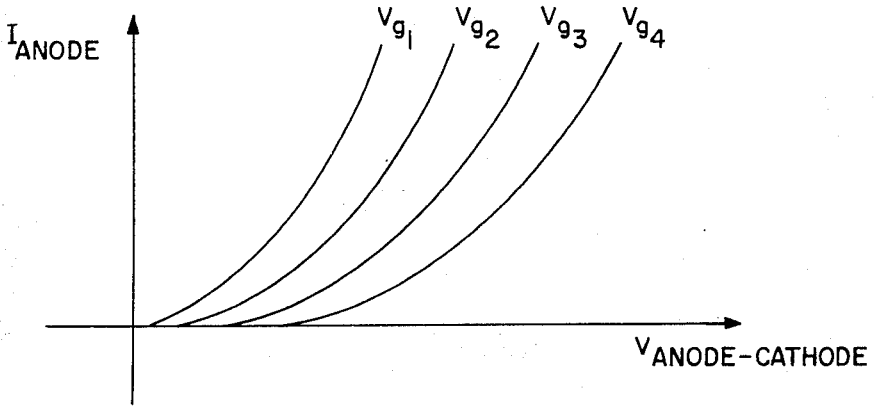
FIG. 5

INTEGRATED STRUCTURE VACUUM TUBE

The invention described herein was made by employees of the United States Government, and may be manufactured and used by or for the government for governmental purposes without payment of any royalties thereon or therefor.

BACKGROUND OF THE INVENTION

The present invention is related to vacuum tubes in general, and, more particularly, to a multi-dimensional thin film tube suitable for use in a high temperature, high radiation environment that conventional silicon semiconductor devices, for example, cannot tolerate.

Vacuum tubes of a ceramic-to-metal construction have long been used in the past for this purpose, but their size, weight and power consumption are all too excessive for large scale applications, such as, for example, a radiation tolerant computer.

More recently, use has been made of one-dimensional integrated vacuum tube structures; however, these are found to be less efficient and of a lower transconductance than is obtainable with tubes having the multi-dimensional structure of the present invention.

SUMMARY OF THE INVENTION

In view of the foregoing, a principal object of the present invention is an integrated structure vacuum tube which exhibits reduced power consumption, size, and weight and greatly reduced cost of production due to the use of integrated circuit processing techniques employed in its fabrication.

In accordance with this object, there is described several alternative embodiments of the invention, which employ circular and linear arrays of thin film electrodes for forming cathodes, anodes and grids. Interconnections between the electrodes, in cases where such connections are required, are made externally as by externally deposited thin or thick films.

Triodes, tetrodes, pentodes, pentagrid converters, for example, are all fabricated by simply depositing additional thin film electrodes as required on the interior surfaces of an alumina envelope.

For example, in the fabrication of a triode structure of circular geometry, there is deposited on one interior wall of the alumina envelope a circular anode comprising a thin film of a refractory metal. Deposited about the anode element is a ring of refractory metal for forming a first grid element. Positioned on the interior wall of the envelope across from the anode element is a second circular deposit of refractory metal for forming a second grid element. Deposited about the second grid element is a thin film ring of triple carbonate forming a cathode element which is formed by heating to approximately 1000° C while under vacuum pumping as with conventional vacuum tubes.

Electrical connection to the several thin film elements is provided by means of hermetically sealed leads or pins which pass through the walls of the envelope for external interconnection and coupling to external power supplies.

Thus, in the triode example, the grid elements are interconnected and coupled to a suitable bias supply while the anode element is coupled to a source of positive potential for collecting the electrons emitted from the cathode element. Electron emission from the cathode is obtained by heating the entire structure to approximately 600° C. Electron flow is from the cathode to the anode through the field generated between the interconnected grid elements. By varying the grid bias, triode characteristics substantially identical to that obtained with conventional tubes is achieved.

In addition to increasing the number of grid elements in a given tube structure to obtain tetrode, pentode, etc. tube characteristics, the thin film electrodes may be made linear and multiplied in number for increased current and power handling capability.

DESCRIPTION OF THE DRAWINGS

The above and other objects, features and advantages of the present invention will become apparent from the following detailed description of the accompanying drawings in which

FIG. 2E is a cross-sectional view taken along the lines E—E of FIG. 2D.

FIG. 2F is a cross-sectional view taken along the lines F—F of FIG. 2D.

FIG. 3A is a top plan view of a pentode of circular geometry of the present invention.

FIG. 3B is a bottom plan view of FIG. 3A.

FIG. 3C is a side elevation view of FIG. 3A with a tube heating oven shown in cross section.

FIG. 3D is a cross-sectional view taken along the lines D—D of FIG. 3B.

FIG. 3E is a cross-sectional view taken along the lines E—E of FIG. 3D.

FIG. 3F is a cross-sectional view taken along the lines F—F of FIG. 3D.

FIG. 4A is a top plan view of a pentode of repeated linear geometry of the present invention.

FIG. 4B is a bottom plan view of FIG. 4A.

FIG. 4C is a side elevation view of FIG. 4A with a tube heating oven shown in cross section.

FIG. 4D is a cross-sectional view taken along the lines D—D of FIG. 4B.

FIG. 4E is a cross-sectional view taken along the lines E—E of FIG. 4D.

FIG. 4F is a cross-sectional view taken along the lines F—F of FIG. 4D.

FIG. 5 is a diagram of typical tube characteristics for the triode of FIG. 1.

Referring to FIGS. 1A–1F, there is provided, in accordance with the present invention, a triode structure of circular geometry comprising a generally cylindrically shaped vacuum envelope 1. Envelope 1 is conveniently formed in two parts 2 and 3 with a pair of facing interior wall surfaces 4 and 5 on which are deposited, as by conventional photolithographic techniques, a plurality of circular and annular thin film members forming a cathode K, an anode A and a pair of grid members $G_1$. Cathode K typically comprises triple carbonate while the anode A and grids $G_1$ typically comprise a refractory metal. Grid $G_1$ on surface 4 is a circular disk generally centrally located. Cathode K is an annular ring concentric with grid $G_1$. Grid $G_1$ on surface 5, like cathode K, is an annular ring concentric with a circular disk forming the anode A. For connection to external power supplies, each of the thin film electrodes is further provided with a coupling pin or lead 6 which passes through and is hermetically sealed in the envelope 1.

Figure 1A:
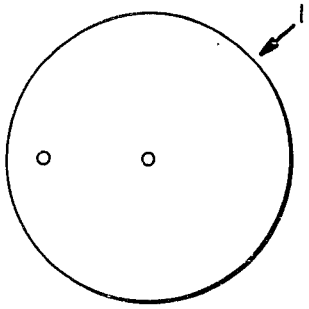
FIG. 1A is a top plan view of a triode of circular geometry in accordance with the present invention.

Upon completion of the deposition of the thin film electrodes and other conventional tube processing — e.g., evacuation, etc., — the parts 2 and 3 of envelope 1 are sealed in a vacuum tight fashion by means of a ceramic-to-metal seal at 7.

In practice, the entire structure is heated to about 600° C for cathode emission in an oven 50 heated by a filament 51 coupled to a supply 52. A positive potential is placed on the anode relative to the cathode with a negative potential placed on the grids $G_1$ using the associated leads 6 connected to these electrodes. Electron flow takes place from the ring cathode to the circular anode through the electric field produced by the grids. By varying the grid voltage, as shown in FIG. 5, the electron flow and hence the anode current I is controllable in substantially the same manner as that employed with conventional triodes.

Figure 1B:
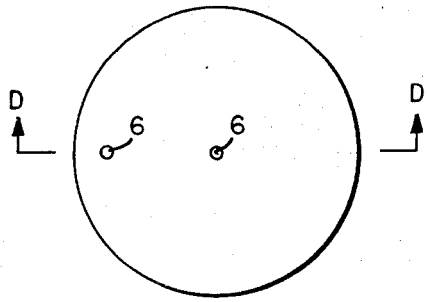
FIG. 1B is a bottom plan view of FIG. 1A.
Figure 1C:
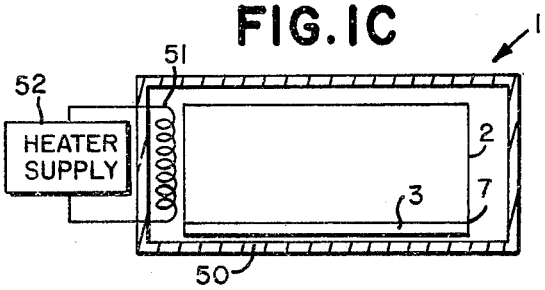
FIG. 1C is a side elevation view of FIG. 1A with a tube heating oven shown in cross section.
Figure 1D:
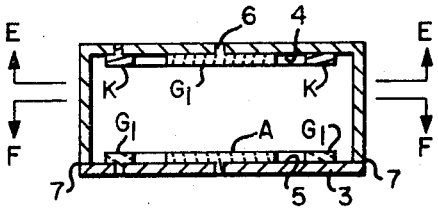
FIG. 1D is a cross-sectional view taken along the lines D—D of FIG. 1B.
Figure 1E:
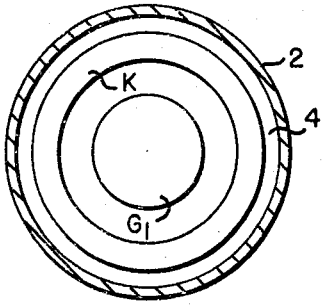
FIG. 1E is a cross-sectional view taken along the lines E—E of FIG. 1D.
Figure 1F:
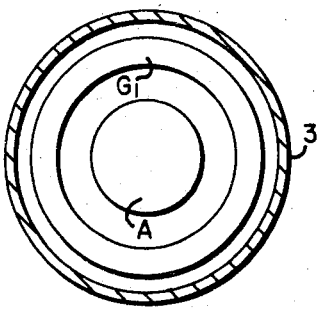
FIG. 1F is a cross-sectional view taken along the lines F—F of FIG. 1D.

For increased current and power handling capability, the circular electrode geometry of FIGS. 1A–1F is changed to a linear geometry and repeated as required.

Figure 2A:
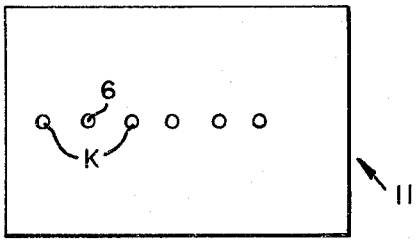
FIG. 2A is a top plan view of a triode of a repeated linear geometry of the present invention.
Figure 2B:
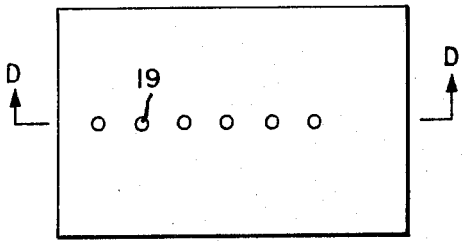
FIG. 2B is a bottom plan view of FIG. 2A.
Figure 2C:
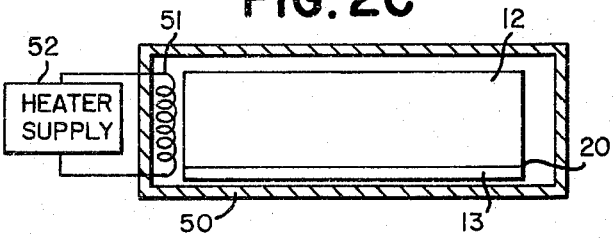
FIG. 2C is a side elevation view of FIG. 2A with a tube heating oven shown in cross section.
Figure 2D:
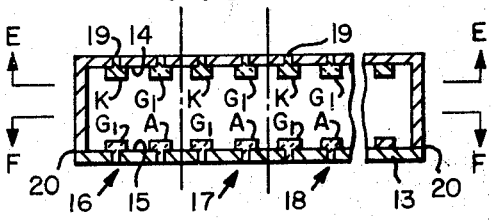
FIG. 2D is a cross-sectional view taken along the lines D—D of FIG. 2B.

Referring to FIGS. 2A–2F, there is provided in this embodiment of a triode structure in accordance with the present invention, a generally rectangular hollow envelope 11. As in the structure of FIGS. 1A–1F, envelope 11 is conveniently formed in two parts 12 and 13, with a pair of facing interior wall surfaces 14 and 15. Deposited on surfaces 14 and 15, as by photolithographic techniques, are a plurality of thin film strips forming plural sets of electrodes 16, 17, 18, etc., each comprising a cathode K, an anode A and a pair of grids $G_1$. The number of sets or sections of electrodes employed depends on the application to be made of the tube and the required current and power handling capability desired. In these respects, the structure of the tube of FIGS. 2A–2F may be compared with, for example, a conventional dual or two-section triode.

In each section, as in section 16 for example, there is provided on wall surface 14 a cathode K and adjacent to and substantially parallel with cathode K, a grid $G_1$. On wall surface 15, there is provided a grid $G_1$ and parallel thereto, an anode A. Each of the electrodes in each section is coupled to an external source of potential (not shown) by means of a pin or lead 19 which passes through and is hermetically sealed in the envelope 11. A ceramic-to-metal seal 20 is also employed for sealing the parts 12 and 13 together in a vacuum tight fashion as was described with respect to the structure of FIGS. 1A–1F.

In use, a positive potential is applied to the anode A relative to the cathode K. When thereafter the entire structure is heated to a temperature of 600° C in an oven 50 heated by a filament 51 coupled to a supply 52, electrons will be emitted by the cathode and will flow to the anode. With an electric field between the grids $G_1$ supplied by an appropriate potential applied to the grids, the electron flow to the anode can be controlled as previously described.

The above described application of potentials to the electrodes of section 16 can also be employed with respect to sections 17 and 18, etc. Alternatively, selected ones of the electrodes in each of the sections can be coupled in parallel by a thin or thick film deposited on the exterior surfaces of envelope 11 in electrical contact with the corresponding pin or lead 19 extending from those electrodes. By so interconnecting the electrodes of two or more sections, increased current and power handling capability is achieved.

The principles and features described with respect to the triode embodiments of FIGS. 1A–1F and 2A–2F are also readily incorporated in more sophisticated tube structures of both circular and repeated linear geometries, such as, for example, tetrodes, pentodes, pentagrid converters, and the like.

Referring to FIGS. 3A–3B, there is provided a pentode structure comprising substantially the same elements as the structure of FIGS. 1A–1F, but with two additional grid pairs, $G_2$ and $G_3$, both of which are deposited on facing wall surfaces 24 and 25 of a generally cylindrical envelope 21. As in the prior described structures, envelope 21 is conveniently formed in two parts 22 and 23, which are ultimately sealed by means of a ceramic-to-metal seal at 27. On the surface 24 there is deposited a cathode element K and a plurality of grid elements $G_1$, $G_2$ and $G_3$. On the surface 25 there is deposited an anode element A and a plurality of corresponding grid elements $G_1$, $G_2$ and $G_3$. Grid element $G_3$ on surface 24 and anode element A on surface 25 generally comprise circular disks of a thin film. Cathode K and grids $G_1$ and $G_2$ on surface 24 and grids $G_1$, $G_2$ and $G_3$ on surface 25 each comprise annular rings of thin film concentric with the grid and anode elements on their respective surfaces. Except for the cathode, which typically comprises a thin film of triple carbonate, the electrodes typically comprise thin films of a refractory metal which are deposited on their respective surfaces as by photolithographic techniques.

To couple each of the electrodes to a suitable source of potential (not shown), there is further provided a plurality of leads or pins 29. Each of the leads are provided to be in electrical contact with a respective one of said electrodes and are passed through and hermetically sealed in the envelope 21.

In use, a positive potential is established between the anode A and cathode K for drawing a flow of electrons to the anode from the cathode when the latter is heated to about 600° C in an oven 50 heated by a filament 51 coupled to a supply 52. Similarly, a constant or selectively variable potential is applied to the grid elements $G_1$ for controlling the flow of electrons. The grid elements $G_2$ are supplied with a potential corresponding to a screen grid potential while a potential suitable for suppressor grid operation is applied to grid elements $G_3$. With suitable potentials employed, the structure of FIGS. 3A–3B is found to exhibit tube characteristics substantially equivalent to those of a conventional pentode.

For a pentode structure according to the present invention having increased current and power handling capability, a repeated linear structure, as seen in FIGS. 4A–4F, is employed.

Referring to FIGS. 4A–4F, there is provided a generally rectangular envelope 31. Envelope 31 is conveniently formed in two parts 32 and 33 with a pair of facing interior wall surfaces 34 and 35. Deposited on surface 34 is a thin film strip of triple carbonate for forming a cathode member K. Adjacent to and parallel with cathode K are a plurality of thin film strips of refractory metal for forming a plurality of grid elements $G_1$, $G_2$ and $G_3$. On the facing surface 35, there is deposited a plurality of thin film strips for forming an anode A and a plurality of corresponding grid elements $G_1$, $G_2$ and $G_3$. With suitable potentials applied to each of the electrodes by external means (not shown), using a pin or lead 39 electrically connected to the electrode through the wall of the envelope 31, the grid members $G_1$, $G_2$ and $G_3$ may be made to function as a control grid, screen grid, and suppressor grid as described with respect to the structure of FIGS. 3A–3F.

While only a single section 40 has been described, it will be appreciated that additional sections, such as section 41, shown in part, may be included in a single envelope 31 by simply repeating the structure and arrangement of the electrodes of section 40 on extended facing wall surfaces of the envelope. Each of the sections 40, 41, etc. may be operated independently, or as described with respect to the triode of FIGS. 2A–2F, selected ones of the electrodes may be electrically interconnected in parallel externally, as by a thin or thick film, for increased current and power handling capability.

In general, the envelopes of each of the embodiments described comprise a material such as alumina because it is a good ceramic insulator for electrically insulating the electrodes and their respective coupling leads; it is easily degassed; can withstand temperatures up to 1400° C continuously; and has a low dielectric loss over a wide frequency range. Similarly, the materials described for the cathode, anode and grid elements are chosen for their compatibility in high temperature, high radiation environment. Nevertheless, other materials are well known which may be used in lieu of the materials described without departing from the spirit and scope of the present invention.

While the alternative embodiments of the present invention described herein include triode and pentode tube structures of circular and repeated linear geometry, it is to be understood that by using more or less than the number of electrodes as described, other tube structures, including but not limited to tetrode and pentagrid converters can also be fabricated. Similarly, in a given application and for a particular set of desired tube characteristics, the anode and cathode members may be located in facing relationship with the grids positioned on opposing sides, and potentials differing from those suggested for obtaining conventional tube characteristics may be selectively employed on the various electrodes for obtaining other tube characteristics.

Further, means other than the oven, filament and supply described may be employed to heat the tube structures with due care being employed to prevent cracking of the structures due to differential heating. Such means may include, for example, resistance heating elements fixed to one or more of the tube walls or other suitable means, such as radiation.

It being understood that other changes within the spirit and scope of the present invention will occur to those skilled in the art, it is intended that the embodiments described are for illustration purposes only and that the spirit and scope of the present invention is to be determined not by the embodiments described but by reference to the claims hereinafter provided.

What is claimed is:

1. Apparatus for an electron discharge device comprising:

a sealed envelope of electrically insulative material with a vacuum environment therein, said envelope having first and second continuous, planar, parallel, separated, opposed surfaces;

a plurality of thin-film electrodes deposited on said first and second surfaces including at least one thermionic cathode electrode and one grid electrode on said first surface, and one anode electrode and one grid electrode on said second surface.

2. Apparatus for an electron discharge device comprising:

first and second continuous, planar, parallel, separated, opposed substrates of electrically insulative material;

a thermionic cathode electrode formed as a conductive film on the surface of said first substrate;

an anode electrode formed as a conductive film on the surface of said second substrate;

a grid electrode formed as a conductive film on the surface of said first substrate adjacent said cathode electrode; and means for maintaining said electrodes within a vacuum.

3. Apparatus as claimed in claim 2 wherein said anode and grid electrodes are circular and said cathode electrode is ring shaped.

4. Apparatus as claimed in claim 2 wherein said electrodes are rectangularly shaped and the longitudinal axes of said electrodes are parallel to one another.

5. Apparatus for an electron discharge device comprising:

a sealed envelope of electrically insulative material with a vacuum environment therein, said envelope having first and second continuous, planar, parallel, spaced apart, facing surfaces;

a thermionic cathode electrode formed as a conductive film on said first surface;

an anode electrode formed as a conductive film on said second surface; and a grid electrode formed as a conductive film on said first surface adjacent to said cathode electrode.

6. Apparatus for an electron discharge device comprising:

a sealed envelope of electrically insulative material with a vacuum environment therein, said envelope having first and second continuous, planar, parallel, spaced apart, facing surfaces;

a thin-film thermionic cathode electrode deposited on said first surface;

a thin-film anode electrode deposited on said second surface; and a thin-film grid electrode deposited on each of said surfaces.

7. Apparatus as set forth in claim 6 wherein all of said electrodes are rectangularly shaped and the longitudinal axes of said electrodes are parallel to one another.

8. Apparatus as set forth in claim 6 wherein:

said grid electrode on said first surface is circularly shaped and surrounded by said cathode electrode; and said anode electrode is circularly shaped and surrounded by said second surface grid electrode.

9. Apparatus as claimed in claim 6 wherein means are provided for electrically communicating with each electrode from the exterior of said envelope.

10. Apparatus as claimed in claim 6 wherein a plurality of thin-film grid electrodes are deposited on each of said surfaces.

11. Apparatus as claimed in claim 6 wherein a plurality of grid and cathode electrodes are deposited on said first surface, and a plurality of grid and anode electrodes are deposited on said second surface.

12. Apparatus for an electric discharge device comprising:

a sealed envelope of electrically insulative material with a vacuum environment therein, said envelope having first and second continuous, planar, parallel, separated, facing surfaces;

a thin-film thermionic cathode electrode deposited on said first surface;

a thin-film control grid electrode deposited on each of said surfaces;

a thin-film screen grid electrode deposited on each of said surfaces;

a thin-film suppressor grid electrode deposited on each of said surfaces; and a thin-film anode electrode deposited on said second surface.

* * * * *